United States Patent [19]

Jeanjean et al.

[11] Patent Number: 4,739,137

[45] Date of Patent: Apr. 19, 1988

[54] HIGH VOLTAGE SULFUR HEXAFLUORIDE CIRCUIT-BREAKER CAPABLE OF OPERATING AT LOW OUTSIDE TEMPERATURES

[75] Inventors: Robert Jeanjean, St-Lambert; Daniel Demissy, Montreal; Guy Saint-Jean, Longueuil; Michel Landry, Ste-Julie, all of Canada

[73] Assignee: Cegelec Industrie Inc., Laprairie, Canada

[21] Appl. No.: 11,488

[22] Filed: Feb. 5, 1987

[30] Foreign Application Priority Data

Feb. 5, 1986 [FR] France ..... 86 01577

[51] Int. Cl.[4] ..... H01H 33/68; H01H 33/92

[52] U.S. Cl. ..... 200/150 B; 200/148 G; 200/150 A

[58] Field of Search ..... 200/148 G, 150 A, 150 B

[56] References Cited

U.S. PATENT DOCUMENTS

| | | | |
|---|---|---|---|
| 3,110,791 | 11/1963 | Aspey et al. | 200/150 B |
| 4,273,978 | 6/1981 | Rostron | 200/150 B |
| 4,604,508 | 8/1986 | Talpo | 200/150 B |

*Primary Examiner*—Robert S. Macon

*Attorney, Agent, or Firm*—Sughrue, Mion, Zinn, Macpeak & Seas

[57] ABSTRACT

A high voltage sulfur hexafluoride circuit-breaker capable of operating at low outside temperatures and comprising at least one current-interrupting chamber comprising a sealed insulating enclosure containing a fixed contact inside a blast nozzle and a set of moving contacts associated with an operating member, the circuit-breaker including the improvement of means for maintaining a quantity of liquefied gas in the vicinity of the contact separation zone while the circuit-breaker is in the closed position.

10 Claims, 4 Drawing Sheets

HIGH VOLTAGE SULFUR HEXAFLUORIDE CIRCUIT-BREAKER CAPABLE OF OPERATING AT LOW OUTSIDE TEMPERATURES

The present invention relates to a high voltage sulfur hexafluoride $SF_6$ circuit breaker capable of being used at very low outside temperature.

BACKGROUND OF THE INVENTION

The interrupting power of an $SF_6$ circuit-breaker depends to a great extent on the pressure inside the circuit-breaking chamber since pressure has a direct effect on the mass flowrate of the $SF_6$ gas used for extinguishing the arc. As temperature falls, so does the pressure of the gas and the mass flowrate is greatly reduced, which can lead to arcs re-striking while the circuit-breaker is interrupting an electric current.

U.S. Pat. No. 4,273,978 describes an $SF_6$ circuit-breaker in which a piston urges liquid $SF_6$ into the contact zone when the circuit-breaker is opened. This arrangement increases the mass flowrate of $SF_6$ at the moment of extinction, but it requires very high operating energy. An aim of the invention is to obtain a high mass flowrate of $SF_6$ when interrupting a current, without requiring the operating energy for opening the circuit-breaker to be increased.

SUMMARY OF THE INVENTION

To this end, the present invention provides for liquefied sulfur hexafluoride to be directed to a zone adjacent to the contacts so that in the presence of an electric arc at the moment when the circuit-breaker opens, the liquid is vaporized, thereby increasing the mass flowrate of vapor through the blast nozzle.

More precisely, the present invention provides a high voltage sulfur hexafluoride circuit-breaker capable of operating at low outside temperatures and comprising at least one current-interrupting chamber comprising a sealed insulating enclosure containing a fixed contact inside a blast nozzle and a set of moving contacts associated with an operating member, the circuit-breaker including the improvement of means for maintaining a quantity of liquefied gas in the vicinity of the contact separation zone while the circuit-breaker is in the closed position.

BRIEF DESCRIPTION OF THE DRAWINGS

A preferred embodiment of the invention is described by way of example with reference to the accompanying drawings, in which.

DESCRIPTION OF PREFERRED EMBODIMENT

Figure 1:
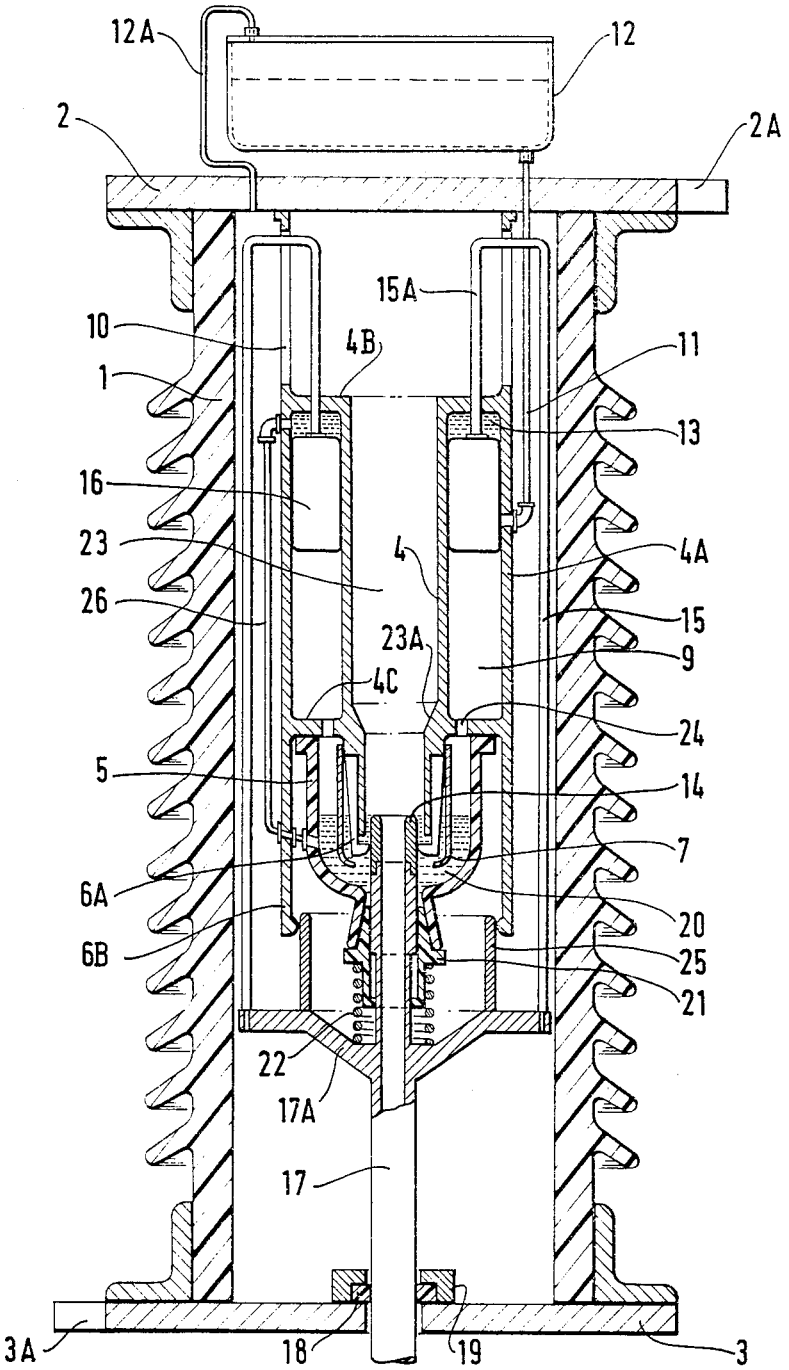
FIG. 1 is an axial section through an interrupting chamber of a circuit-breaker in accordance with the invention and shown in its closed position.

The circuit-breaker chamber comprises:

(a) An insulating envelope 1 having good pressure performance, and closed at each end in sealed manner by respective metal end plates 2 and 3 having respective current connection fittings 2A and 2A.

(b) A set of fixed contacts comprising a tubular metal support 4 having an insulating nozzle 5 fixed thereto together with two-tab contact fingers 6A and 6B. The fingers 6A are made of tungsten and serve as arcing contacts whereas the fingers 6B are made of silver-plated copper and serve as permanent contacts. In a variant, fingers could be used having single tungsten silver tabs and serving both as arcing contacts and as permanent contacts.

(c) A set of moving contacts including an electrode 14 which may be hollow or solid, a ring of fingers 25 made of copper tungsten alloy, and a system of insulating rods 15 for fixing the electrode 14 to a moving piston 16. The electrode 14 is fixed to a metal cylinder 17 which slides via sliding electric contacts 18 in another metal cylinder 19 which is fixed to end plate 3. The main moving contacts 25 and the insulating fingers 15 are fixed on a support 17A which is fixed in turn to the cylinder 17. The cylinder 17 is connected, outside the envelope, to operating means (not shown).

A metal deflector 7 surrounds the contact fingers, thereby providing better die electric performance. The nozzle delimits an inside volume 20 which is partially filled with liquefied gas when the circuit-breaker is in the closed position, as described below.

The annular chamber piston 16 is capable of moving in an annular 9 which is delimited by a portion of the tubular support 4, a coaxial tube 4A, and two end pieces 4B and 4C. The end piece 4C has channels 24 passing therethrough for putting the volume 20 into communication with the volume 9. The end piece 4B has sealed passages therethrough for passing the piston rods 15A.

A duct 11 connects the volume 9 to a tank 12 located above the circuit-breaking chamber. This tank is put into communication with the inside of the chamber by a duct 12A. The pressure to which the chamber is filled with $SF_6$ is chosen so that at low outside temperatures (for example less than 0° C.), the tank 12 contains a considerable quantity of liquefied gas. The duct 11 opens out into the volume 9 level with the piston so that the liquid remains above the piston so long as the circuit-breaker is in the closed position.

A transfer duct 26 serves to transfer liquid $SF_6$ from the volume 13 to the volume 20 of the insulating nozzle during a closure maneuver in a manner explained below.

A cone 21 whose profile corresponds to that of the diverging portion of the nozzle 5 is threaded over the electrode 14. The cone is used to close the nozzle when the circuit-breaker is in the closed position.

A spring 22 is disposed between the cone 21 and the support 17A.

The tube 4A is extended by a metal portion 10 for allowing current to pass from the end plate 2 to the end plate 3 via the portion 10, the tubes 4 and 4A, the contacts 6B and 25, the support 17A, the tube 17, and the contacts 18.

The circuit breaker operates as follows:

(a) Opening operation

The apparatus is in its closed position (see FIG. 1). Liquid $SF_6$ is contained in the volume 20. The manner in which this liquid reaches this volume is explained below.

The operating member acts on the cylinder 17 by pulling it downwardly until the electrode 14 arrives to the throat of the nozzle 5. The spring 22 serves to ensure that the cone 21 keeps the nozzle closed.

Figure 2:
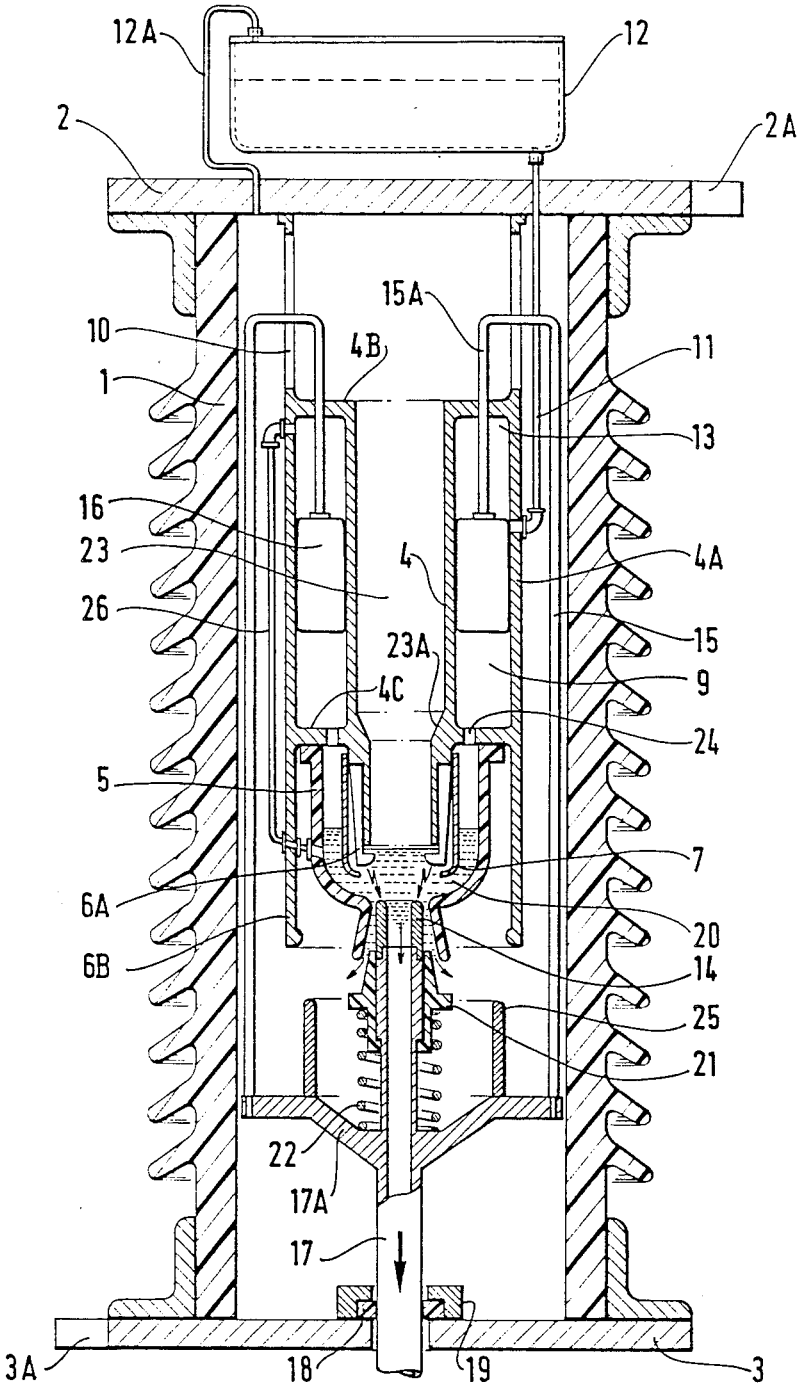
FIG. 2 is an axial section through the same chamber in an intermediate position during an opening operation.

An electric arc 27 is struck between the electrode 14 and the arcing contacts 6A (see FIG. 2) immersed in the liquid $SF_6$, thereby vaporizing the $SF_6$. This high density of $SF_6$ is kept close to the arc by the action of gas coming from the volume 9 and blasted by the piston 16 through the orifices 24.

The gas escapes via the throat of the nozzle towards the volume 23 delimited by the tube 4. The volume 23 advantageously has a nozzle-forming necked portion 23A.

Figure 3:
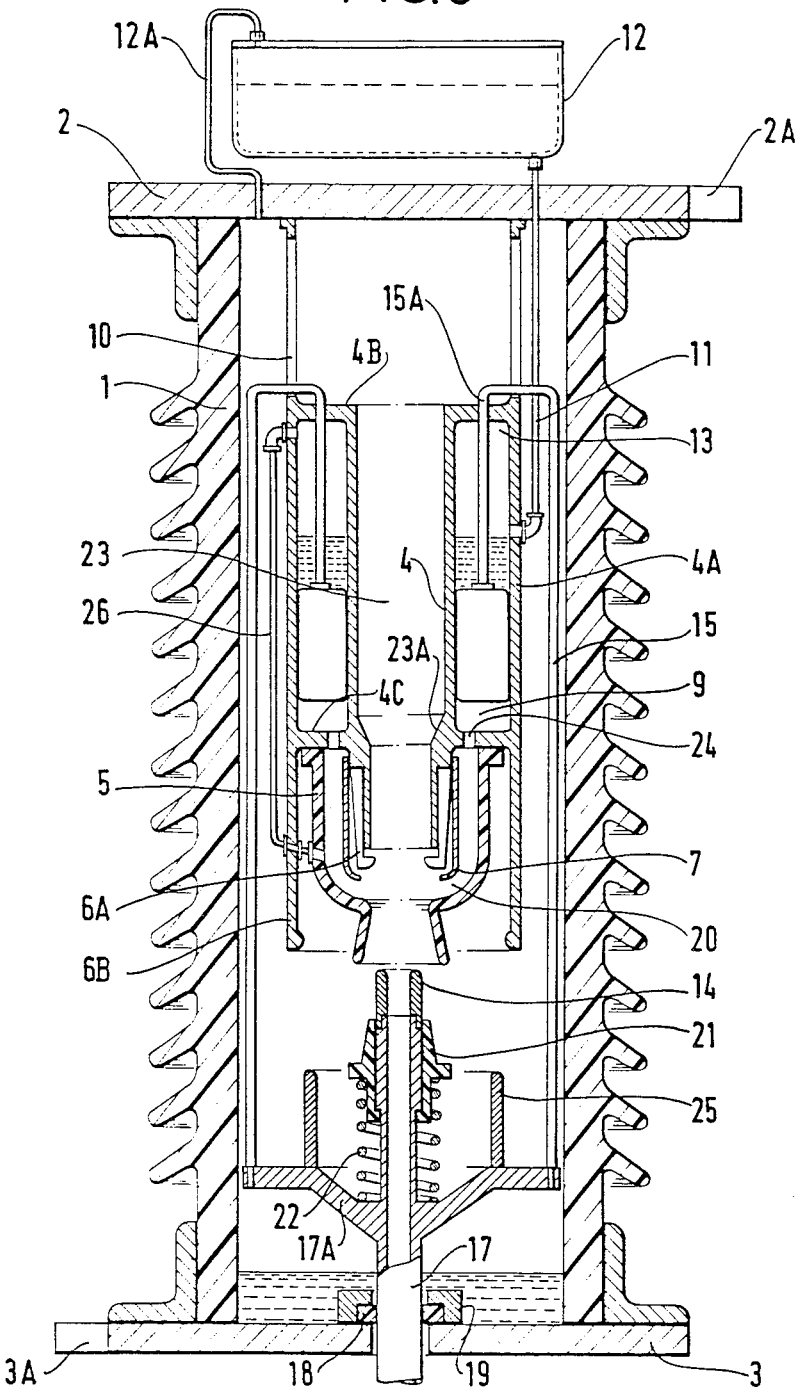
FIG. 3 is an axial section through the same chamber in its open position.

The moving electrode continues its stroke until the circuit-breaker is fully open (see FIG. 3), thus moving the cone 21 away from the nozzle. At the moment that zero current passes, the mass flowrate through the nozzle 23 and the throat of the blast nozzle is very high because of the high upstream pressure, thereby interrupting the arc.

The duct 11 is then unblocked and the volume 13 is filled with liquid $SF_6$ under the effect of gravity. The liquefied gas is thus stored in a storage zone constituted by the volume 13 until the circuit-breaker is re-closed.

(b) Closure operation

The operating member acts on the cylinder 17 and thrusts it upwardly.

Figure 4:
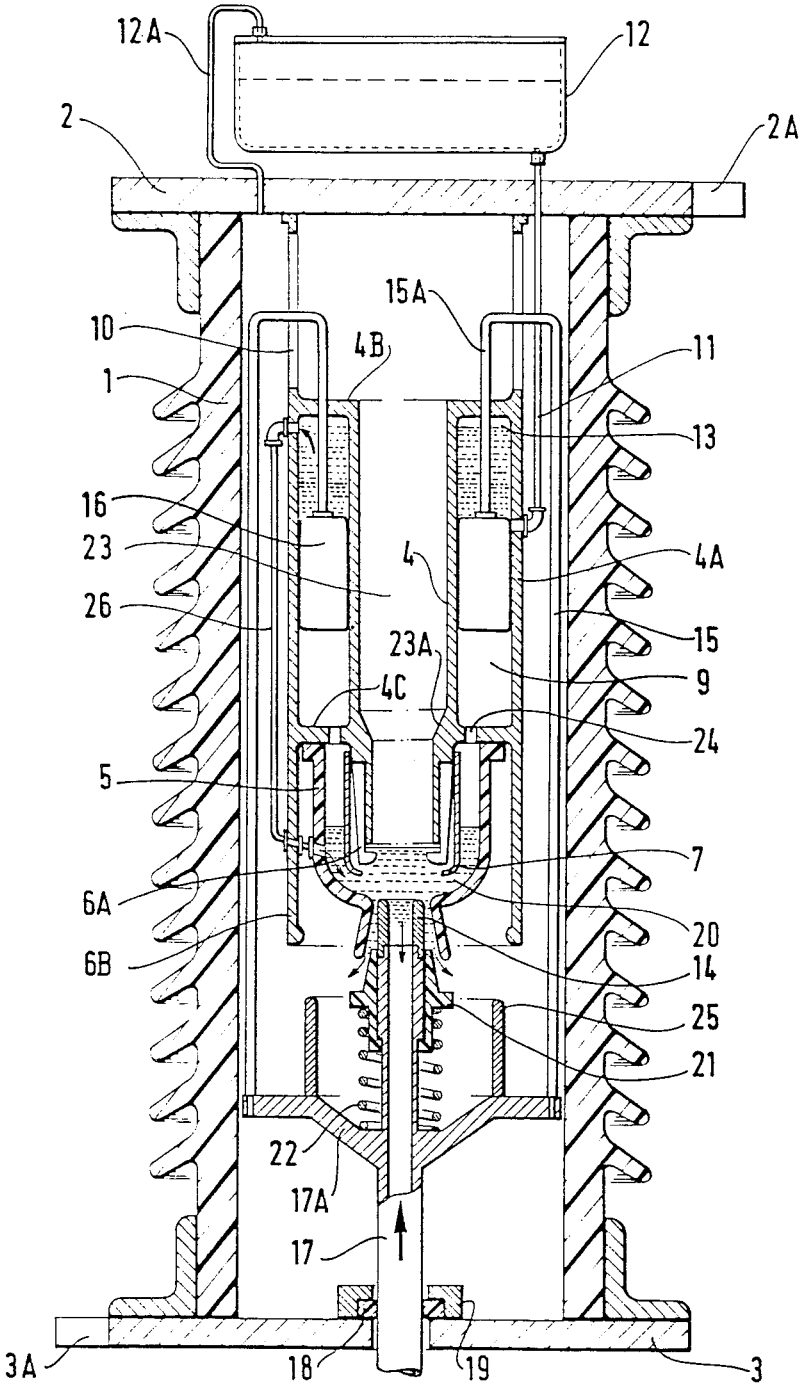
FIG. 4 is an axial section through the same chamber in an intermediate position during a closure operation.

The piston 16 then expels the liquid from the volume 13 into the volume 20 via the duct 26 (see FIG. 4). A portion of the liquid runs away until the cone 21 closes the divergent portion of the gap between the nozzle 3 and the electrode 14.

By suitably selecting the volumes and the strokes involved, a sufficient quantity of liquid can be put into the volume 20.

Once closed, the apparatus is again ready for an opening operation.

The invention is not limited to the embodiment described. In particular, the tank 12 above the chamber may be replaced by a tank placed below the circuit-breaker and fitted with a pump.

We claim:

1. In a high voltage sulfur hexafluoride circuit-breaker capable of operating at low outside temperatures and comprising a sealed insulating enclosure containing at least one current-interrupting chamber, a blast nozzle, a fixed contact inside said blast nozzle, a set of moving contacts operatively associated with an operating member, means for maintaining a quantity of liquefied gas in the vicinity of a contact separation zone defined by said fixed contact and said set of moving contacts, while the circuit-breaker is in the closed position, said means comprising tank of liquefied gas, a storage zone, a duct for transferring liquefied gas from said tank to said storage zone when the circuit-breaker is in the open position, and a relatively movable piston in contact with said liquefied gas within said storage zone for transferring said quantity of liquefied gas from the storage zone into the contact separation zone during circuit-breaker closure operation, said piston being fixed to the circuit-breaker operating member and moving vertically, the improvement wherein said storage zone is situated above the piston, said piston is a double-acting piston having opposed faces, with the face of the piston facing away from the storage zone serving to compress the gas and to direct it towards the contact separation zone during circuit-breaker opening operation.

2. A circuit-breaker according to claim 1, wherein said tank is provided above said current-interrupting chamber and is in communication with the inside of said chamber, and said duct opening out at the level of the piston when the circuit-breaker is in its closed position.

3. A circuit-breaker according to claim 1, wherein said liquefied gas comes from a tank at the base of the circuit-breaker, with said tank being associated with a pumping system.

4. A circuit-breaker according to claim 1, wherein said contact separation zone in which a quantity of liquefied gas is maintained while the circuit-breaker is in the closed position is partially delimited by said blast nozzle and an insulating piece fixed to the moving contact closes off said blast nozzle in a sealed manner while the circuit-breaker is in the closed position.

5. A circuit-breaker according to claim 2, wherein said contact separation zone in which a quantity of liquefied gas is maintained while the circuit-breaker is in the closed position is partially delimited by said blast nozzle and an insulating piece fixed to the moving contact closes off said blast nozzle in a sealed manner while the circuit-breaker is in the closed position.

6. A circuit-breaker according to claim 3, wherein said contact separation zone in which a quantity of liquefied gas is maintained while the circuit-breaker is in the closed position is partially delimited by said blast nozzle and an insulating piece fixed to the moving contact closes off said blast nozzle in a sealed manner while the circuit-breaker is in the closed position.

7. In a high voltage sulfur hexafluoride circuit breaker capable of operating at low outside temperatures and comprising a sealed insulating enclosure containing at least one current-interrupting chamber, a blast nozzle, a fixed contact inside said blast nozzle, a set of moving contacts operatively associated with a operating member, means for maintaining a quantity of liquefied gas in the vicinity of a contact separation zone defined by said fixed contact and said set of moving contacts, while the circuit breaker is in the closed position, said means comprising a tank of liquefied gas, a storage zone, a duct for transferring liquefied gas from said tank to said storage zone when the circuit breaker is in the open position, and a relatively movable piston in contact with said liquefied gas within said storage zone for transferring said quantity of liquefied gas from the storage zone into the contact separation zone during circuit-breaker closure operation, said piston being fixed to the circuit-breaker operating member, the improvement wherein said tank is provided above the current-interrupting chamber and is in communication with the inside of the chamber, and said duct opens out at the level of the piston when the circuit breaker is in its closed position.

8. In a high voltage sulfur hexafluoride circuit breaker capable of operating at low outside temperatures in comprising a sealed insulating enclosure containing at least one current-interrupting chamber, a blast nozzle, a fixed contact inside said blast nozzle, a set of moving contacts operatively associated with a operating member, means for maintaining a quantity of liquefied gas in the vicinity of a contact separation zone defined by said fixed contact and said set of moving contacts, while the circuit breaker is in the closed position, said means comprising a tank of liquefied gas, a storage zone, a duct for transferring liquefied gas from said tank to said storage zone when the circuit breaker is in the open position, and a relatively movable piston in contact with said liquefied gas within said storage zone for transferring said quantity of liquefied gas from the storage zone into the contact separation zone during circuit-breaker closure operation, said piston being fixed to the circuit-breaking operating member, the improvement wherein the liquefied gas comes from a tank at the base of the circuit-breaker, with said tank being associated with a pumping system.

9. A circuit-breaker according to claim 7, wherein said contact separation zone in which a quantity of liquefied gas is maintained while the circuit-breaker is in the closed position is partially delimited by said blast nozzle and an insulating piece fixed to the moving contact closes off said blast nozzle in a sealed manner while the circuit breaker is in the closed position.

10. A circuit-breaker according to claim 8, wherein said contact separation zone in which a quantity of liquefied gas is maintained whilethe circuit-breaker is in the closed position is partially delimited by said blast nozzle and an insulating piece fixed to the moving contact closes off said blast nozzle in a sealed manner while the circuit-breaker is in the closed position.

* * * * *